US008231126B2

(12) United States Patent
Shimonaga

(10) Patent No.: US 8,231,126 B2
(45) Date of Patent: Jul. 31, 2012

(54) MEDIUM-DIRECTING DEVICE AND IMAGE-FORMING APPARATUS

(75) Inventor: Akio Shimonaga, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 90 days.

(21) Appl. No.: 12/851,048

(22) Filed: Aug. 5, 2010

(65) Prior Publication Data

US 2011/0062661 A1 Mar. 17, 2011

(30) Foreign Application Priority Data

Sep. 14, 2009 (JP) ..... 2009-212435

(51) Int. Cl.
*B65H 39/10* (2006.01)

(52) U.S. Cl. ..... 271/304; 271/291; 271/301; 271/303; 271/186

(58) Field of Classification Search ..... 271/291, 271/301, 303, 304, 186
See application file for complete search history.

(56) References Cited

U.S. PATENT DOCUMENTS 4,986,529 A * 1/1991 Agarwal et al. ..... 271/291
5,947,464 A * 9/1999 Takada ..... 271/3.03
6,522,860 B2 * 2/2003 Nose et al. ..... 399/374
6,808,171 B2 * 10/2004 Carter et al. ..... 271/186
6,814,353 B1 * 11/2004 Kakuta et al. ..... 271/186
7,431,293 B2 * 10/2008 Carter et al. ..... 271/303
7,918,451 B2 * 4/2011 Honda et al. ..... 271/225
2005/0035540 A1 * 2/2005 Carter et al. ..... 271/303
2008/0279601 A1 * 11/2008 Sahara et al. ..... 399/401

FOREIGN PATENT DOCUMENTS

JP 63235250 A * 9/1988
JP A-2001-063892 3/2001
JP A-2006-193328 7/2006

* cited by examiner

*Primary Examiner* — Kaitlin Joerger
*Assistant Examiner* — Prasad Gokhale
(74) *Attorney, Agent, or Firm* — Oliff & Berridge, PLC

(57) ABSTRACT

A medium-directing device includes: first-third roll members, the third roll member contacting the first and second roll members in first and second regions, respectively; and a directing member having first and second directing surfaces and being rotatable between first and second positions such that the directing member, when located at the first position, directs a medium conveyed along a first conveyance path toward the first region via the first directing surface and directs a medium conveyed from the second region toward a second conveyance path via the second directing surface, the directing member including a region of the second directing surface on a side closer to the second region relative to a bent portion, in which, when the directing member is at the first position, a distance between the second directing surface and a tangential line between the second and third roll members increases toward the second region.

7 Claims, 8 Drawing Sheets

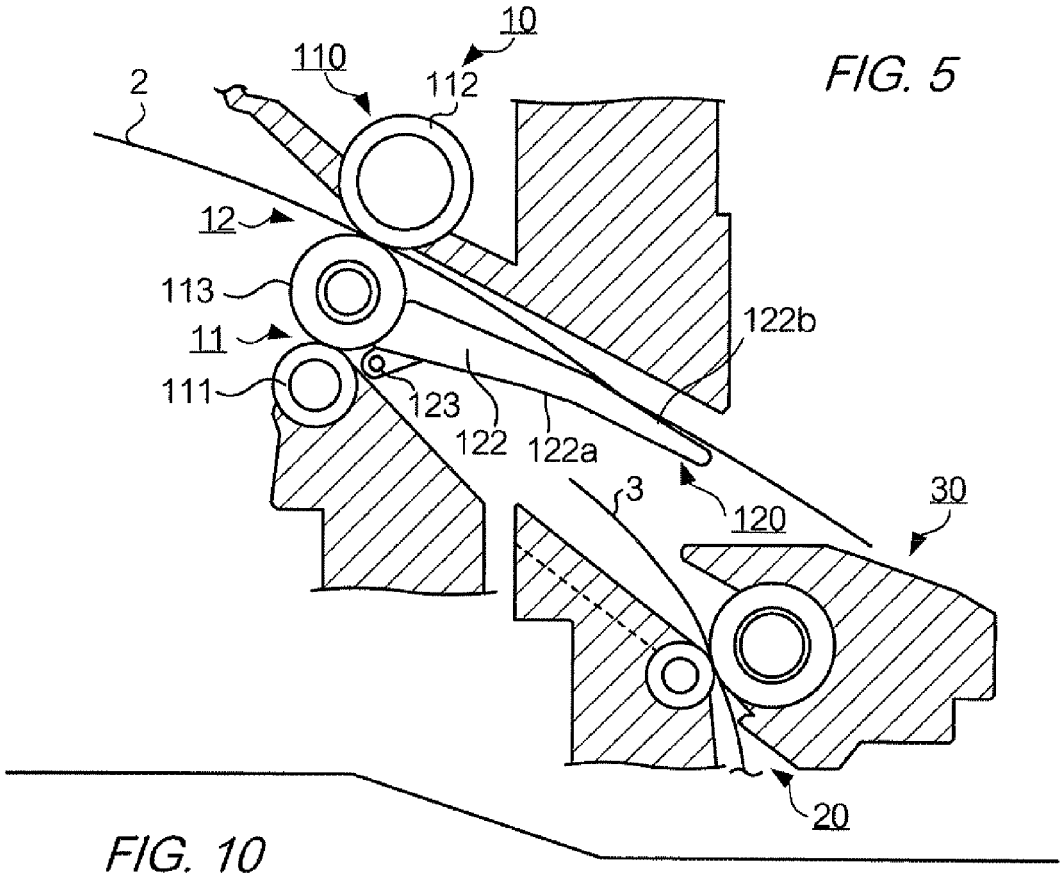
FIG. 5
FIG. 10
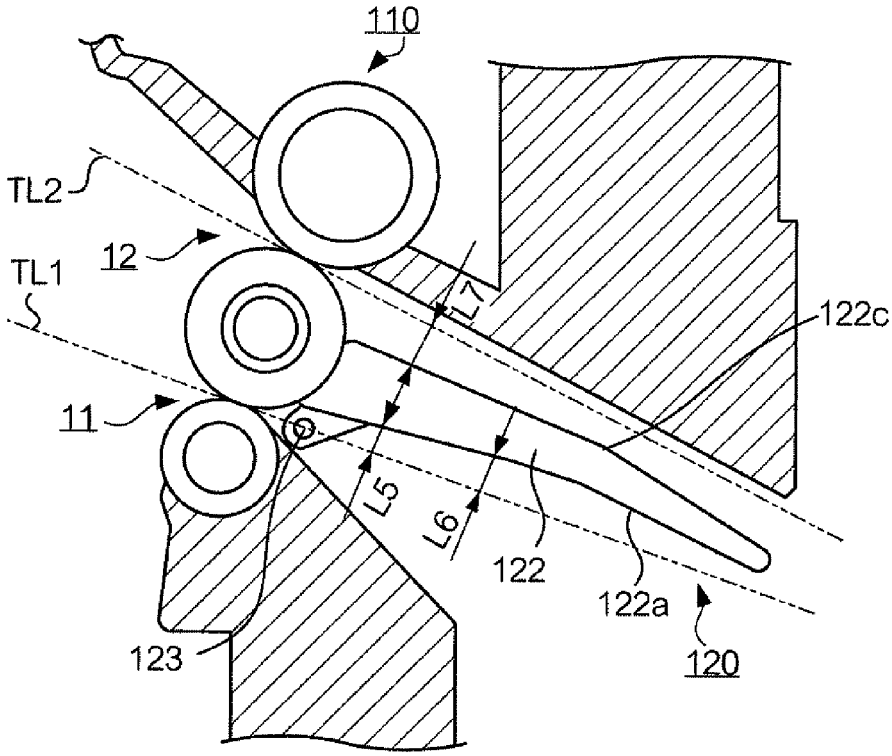

MEDIUM-DIRECTING DEVICE AND IMAGE-FORMING APPARATUS

CROSS-REFERENCE TO RELATED APPLICATIONS

This application is based on and claims priority under 35 U.S.C. 119 from Japanese Patent Application No. 2009-212435, which was filed on Sep. 14, 2009.

BACKGROUND

1. Technical Field

The present invention relates to a medium-directing device and an image-forming apparatus.

2. Related Art

In some image-forming apparatuses, a conveyance path of a recording medium on which an image is formed can be switched to form an image on each side of the recording medium.

SUMMARY

In one aspect of the invention, there is provided a medium-directing device including: a first roll member that is rotatable about a first rotation shaft; a second roll member that is rotatable about a second rotation shaft; a third roll member that is rotatable about a third rotation shaft in forward and reverse directions and that respectively contacts the first roll member and the second roll member in first and second regions, which regions are at different positions, such that when the third roll member is rotated in the forward direction, a medium conveyed along a first conveyance path is nipped between the first roll member and the third roll member in the first region, and when the third roll member is rotated in the reverse direction, the medium conveyed along the first conveyance path is nipped between the second roll member and the third roll member in the second region; a directing member that has a fulcrum, a first directing surface, and a second directing surface provided with a bent portion, and that is rotatable about the fulcrum between a first position and a second position such that when the directing member is located at the first position, the medium conveyed along the first conveyance path is directed by the first directing surface toward the first region, and when the directing member is located at the second position, the medium conveyed along the first conveyance path is directed by the second directing surface toward the second region; a guiding unit that, when the third roll member is rotated in the forward direction with a medium being nipped between the second roll member and the third roll member in the second region, guides the medium conveyed by the rotation of the third roll member toward a second conveyance path that is different from the first conveyance path; and a moving unit that moves the directing member between the first position and the second position, the moving unit moving the directing member to the first position when the third roll member is rotated in the forward direction with a medium being nipped between the second roll member and the third roll member in the second region, wherein the fulcrum of the directing member is provided at a position that, when the directing member is located at the first position, is apart from the first directing surface toward a first tangential line, the first tangential line being a tangential line that passes through the first region and is common to the first roll member and the third roll member, and the directing member includes a region of the first directing surface, in which, when the directing member is located at the first position, a distance between the first directing surface and the first tangential line reduces toward the first region, and a region of the second directing surface on a side closer to the second region relative to the bent portion, in which, when the directing member is located at the first position, a distance between the second directing surface and a second tangential line increases toward the second region, the second tangential line being a tangential line that passes through the second region and is common to the second roll member and the third roll member.

BRIEF DESCRIPTION OF THE DRAWINGS

Exemplary embodiments of the present invention will now be described in detail with reference to the following figures, wherein:

FIG. 5 is a diagram for explaining an operation of the directing unit for conducting the discharging and re-entry of recording media at the same time;

FIG. 10 is a diagram for explaining a directing surface and a fulcrum.

DETAILED DESCRIPTION

Exemplary Embodiment

Figure 1:
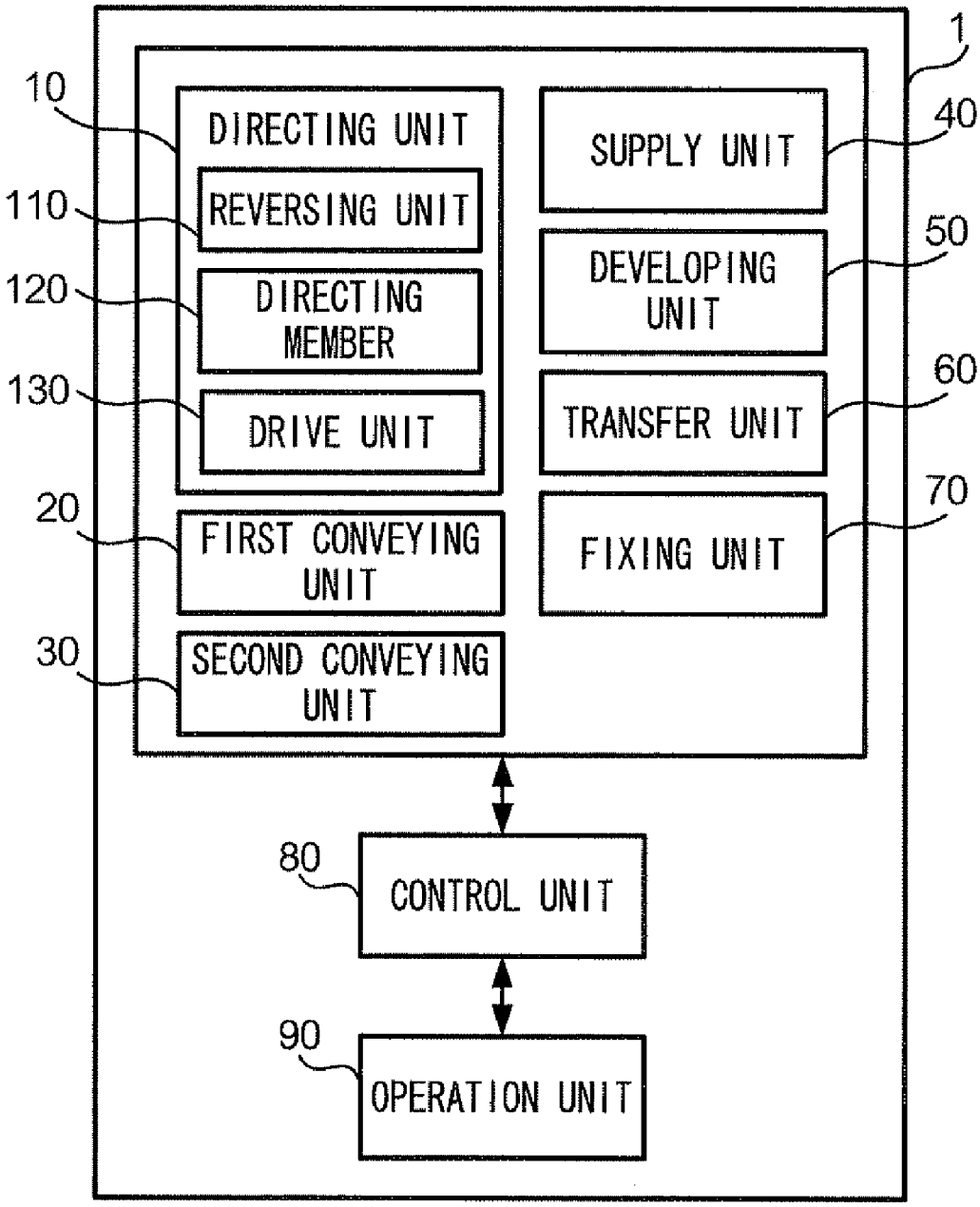
FIG. 1 is a block diagram of an image-forming apparatus according to an exemplary embodiment of the present invention.

FIG. 1 is a block diagram of image-forming apparatus 1 according to an exemplary embodiment of the present invention. Image-forming apparatus 1 includes directing unit 10, first conveying unit 20, second conveying unit 30, supply unit 40, developing unit 50, transfer unit 60, and fixing unit 70. Supply unit 40 contains recording media and supplies the recording media to first conveying unit 20. First conveying unit 20 conveys the recording media to transfer unit 60. Transfer unit 60 functions to transfer an image formed by developing unit 50 onto a recording medium. Developing unit 50 has a photosensitive member, on which a toner image is formed by developing an image. The toner image formed on the photosensitive member is transferred onto transfer unit 60. Transfer unit 60 transfers the image, which has been transferred thereon from developing unit 50, onto a recording medium. First conveying unit 20 conveys the recording medium, on which an image has been transferred, to fixing unit 70. Fixing unit 70 has a heat-generating member, and applies a heat and pressure to the recording medium to thereby fix the image on the recording medium. In the present exemplary embodiment, developing unit 50, transfer unit 60, and fixing unit 70 function cooperatively to serve as an image-forming unit.

First conveying unit 20 conveys the recording medium, on which an image has been fixed, to directing unit 10. Directing unit 10 has reversing unit 110 and directing member 120, which will be described later. Control unit 80 includes a processing unit, such as a CPU (Central Processing Unit), and a memory unit, such as a RAM (Random Access Memory), and performs processing of image formation and controls an operation of each unit described in the foregoing. Operation unit 90 includes a touch panel, keyboard, or the like via which a user can input instructions such as selection, confirmation, cancellation, etc., to image-forming apparatus 1. Operation unit 90 outputs information indicating contents of user operations to control unit 80. Arrangement of various parts constituting image-forming apparatus 1 will now be explained.

Figure 2:
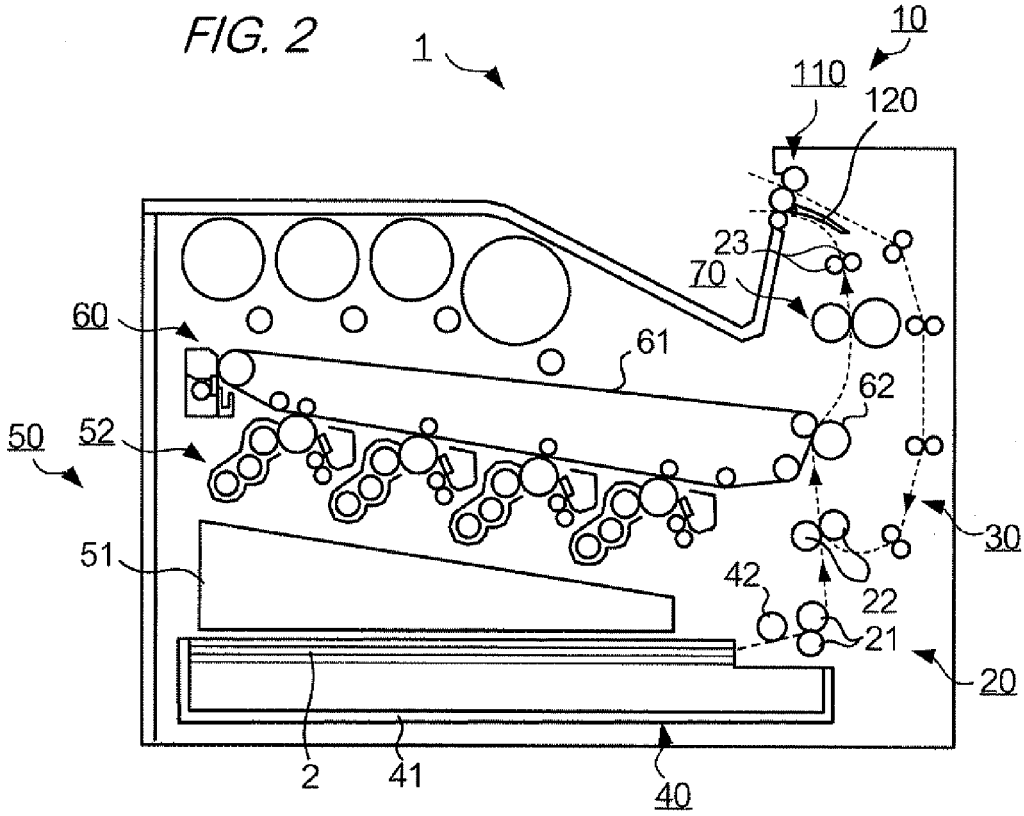
FIG. 2 is a schematic view of the image-forming apparatus.

FIG. 2 is a schematic diagram of image-forming apparatus 1. Supply unit 40 includes container member 41 and rotating member 42. Container member 41 is a box-shaped casing made of plastic or the like, containing sheets of recording media 2 of a variety of sizes. Rotating member 42 functions to convey and supply recording media 2 contained in container member 41 to first conveying unit 20. Recording media 2 are sheet-shaped media made of paper, plastic or the like, and an image may be formed on one side or on each side of each sheet of recording media 2. Recording media 2 each have one of predetermined sizes. First conveying unit 20 includes conveying rolls 21, 22, 23, which are rotating members, for conveyance of recording media 2. A toner image formed by developing unit 50 is transferred via transfer unit 60 to recording media 2 that are conveyed.

Developing unit 50 has light-scanning unit 51 and image-developing unit 52. Light-scanning unit 51 includes a light-irradiating member and a light-reflecting member, and irradiates light in accordance with image information toward image-developing unit 52. Light-scanning unit 51 scans a photosensitive member of image-developing unit 52 with the light. Image-developing unit 52 forms a toner image in accordance with the scanning conducted by light-scanning unit 51, and transfers the toner image onto intermediate transfer belt 61. Intermediate transfer belt 61 is an endless belt member, and is rotatably supported by plural roll members. Intermediate transfer belt 6*a* contacts a sheet of recording media 2 at a position opposed to secondary transfer member 62. Secondary transfer member 62 is a rotating member, and presses the sheet of recording media 2 against intermediate transfer belt 61 to transfer the toner image onto the sheet of recording media 2. Fixing unit 70 has a heat source such as a halogen lamp, and fixes a toner image, which has been transferred onto the sheet of recording media 2, by applying a pressure and heat. The sheet of recording media, on which an image has been fixed, is conveyed to directing unit 10 by means of roll 23 of first conveying unit 20. In the present exemplary embodiment, the path through which first conveying unit 20 conveys recording media 2 from supply unit 40 to directing unit 10 corresponds to and serves as an example of a "first conveyance path" of the invention.

As mentioned in the foregoing, directing unit 10 includes reversing unit 110 and directing member 120. Directing member 120 has a moveable member for switching a path through which recording media 2 are conveyed. Directing member 120 directs recording media 2 to reversing unit 110 in accordance with switching of the path. Reversing unit 110 has three rotating members for conveying recording media 2. In a case where image formation on a sheet of recording media 2 has been completed, directing unit 10 directs the sheet of recording media 2 to be discharged to an outside of image-forming apparatus 1. In a case where an image is to be formed on each side of a sheet of recording media 2, directing unit 10 directs the sheet of recording media 2, on one side of which an image is formed, such that the sheet of recording media 2 is guided back to an inside of image-forming apparatus 1.

The directed sheet of recording media 2 is guided to an inside of image-forming apparatus 1 by second conveying unit 30. Second conveying unit 30 conveys a sheet of recording media 2 along a path different from that of first conveying unit 20. Second conveying unit 30 sends out the sheet of recording media 2 so that an additional toner image is transferred onto the sheet of recording media 2. At this time, the sheet of recording media 2 is sent out with its front and back sides being reversed so that the side opposite to that having an image formed thereon is brought into contact with intermediate transfer belt 61. Onto the conveyed sheet of recording media 2, an image is transferred and fixed again by transfer unit 60 and fixing unit 70. Roll 23 of first conveying unit 20 conveys the sheet of recording media 2, on each side of which an image has been fixed, to directing unit 10. Directing unit 10 discharges the sheet of recording media 2, which has been conveyed, through a path that is different from that through which the sheet of recording media 2 was conveyed to second conveying unit 30. In the foregoing-described manner, image-forming apparatus 1 forms an image on a side of the sheet of recording media 2, on an opposite side of which an image has been formed. In the present exemplary embodiment, the second conveying unit corresponds to and serves as an example of a "guiding unit" of the invention. Also, the path through which the second conveying unit conveys recording media 2 from directing unit 10 to first conveying unit 20 corresponds to and serves as an example of a "second conveyance path" of the invention.

Figure 3:
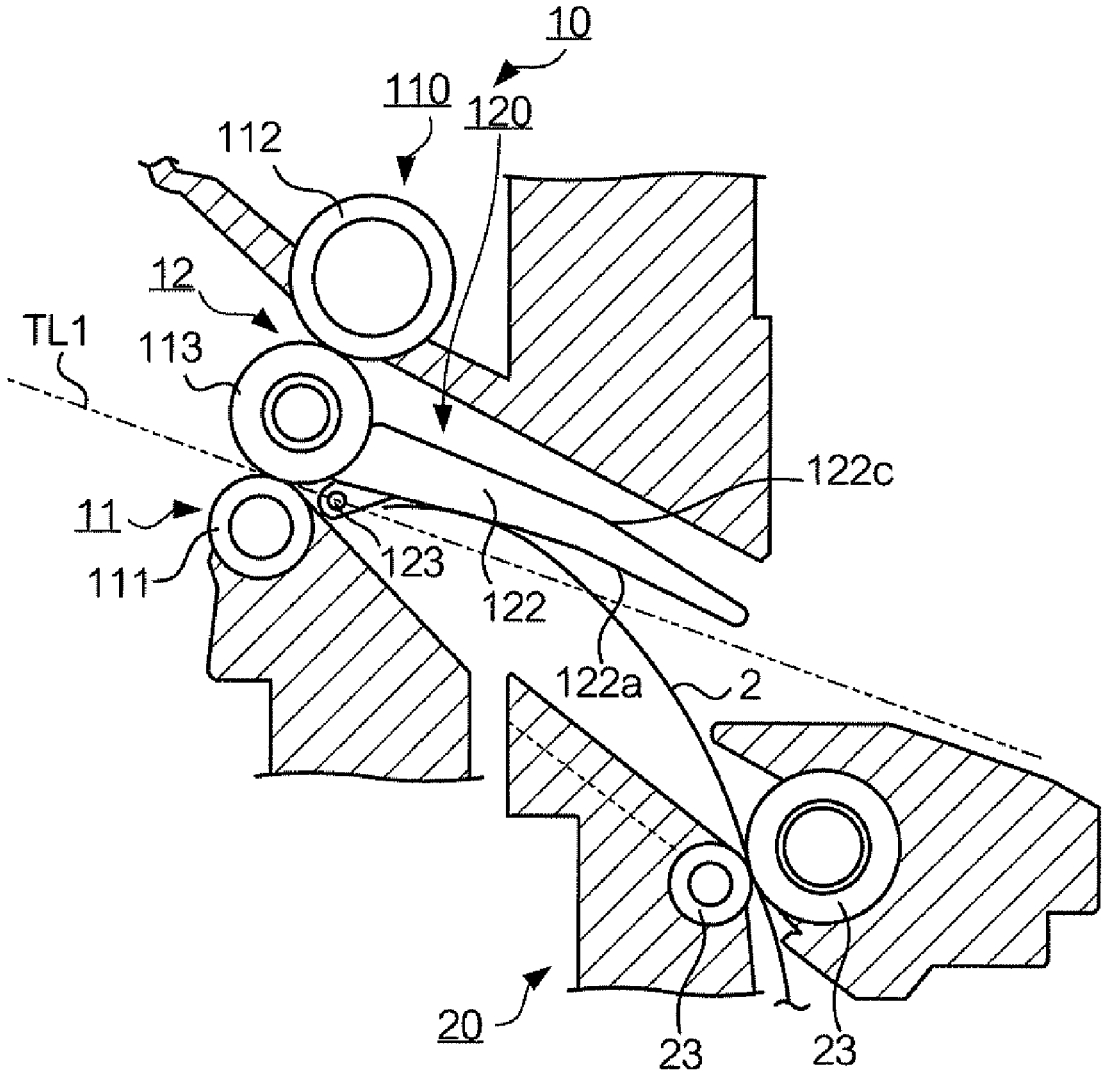
FIG. 3 is a diagram for explaining an operation of a directing unit for discharging a recording medium.

FIG. 3 is a diagram for explaining an operation of directing unit 10 for discharging recording media 2. As stated in the foregoing, directing unit 10 has reversing unit 110 and directing member 120. Reversing unit 110 includes first roll member 111, second roll member 112, and third roll member 113, which are members rotating about respective rotation shafts. Third roll member 113 contacts first roll member 111 and second roll member 112 at different positions. First roll member 111 contacts third roll member 113 in first region 11, while second roll member 112 contacts third roll member 113 in second region 12. Rotation of third roll member 113 is controlled by control unit 80. When third roll member 113 rotates, first and second roll members 111 and 112 are provided with a rotational force from third roll member 113 contacting them in first and second regions 11 and 12, respectively, whereby first and second roll members 111 and 112 are caused to rotate. The direction in which the first and second roll members 111 and 112 rotate is opposite to that in which third roll member 113 rotates.

Directing member 120 has fulcrum 123 serving as a rotation shaft and rotatable switching member 122. Switching member 122 has bent portion 122*c*. Fulcrum 123 is rotatable within a range predetermined by a limiting member (not shown in the drawings) that limits the rotation of switching member 122. Switching member 122 is urged by an urging member such as a spring (not shown in the drawings) counterclockwise as viewed in FIG. 3. It is to be noted that "urging" means applying a force in a certain direction. In the following description, a position at which the counterclockwise rotation of switching member 122 is limited will be referred to as a "first position." FIG. 3 shows switching member 122 at the first position. Switching member 122 has first directing surface 122*a* on a side of first region 11. First directing surface 122*a* is shaped such that when switching member 122 is at the first position, a distance from first directing surface 122*a* to tangential line TL1 between first and third roll members 111 and 113 decreases toward third roll member 113.

Roll 23 of first conveying unit 20 conveys recording medium 2 toward switching member 122. When the conveyed recording medium 2 collides against first directing surface 122*a*, first directing surface 122*a* directs a sheet of recording media 2 toward first region 11, so that the sheet of recording media 2 reaches first region 11. The sheet of recording media 2, on reaching first region 11, is nipped between third roll member 113 and first roll member 111. At this time, control unit 80 controls third roll member 113 to rotate clockwise as viewed in FIG. 3. Thus, third roll member 113 rotates clockwise and first roll member rotates counterclockwise, to thereby discharge the sheet of recording media 2 nipped between them. In the present exemplary embodiment, the clockwise direction as viewed in FIG. 3 corresponds to and serves as an example of a "forward direction" of the invention. In a manner described in the foregoing, directing unit 10 discharges the sheet of recording media 2 to an outside of image-forming apparatus 1.

Figure 4A:
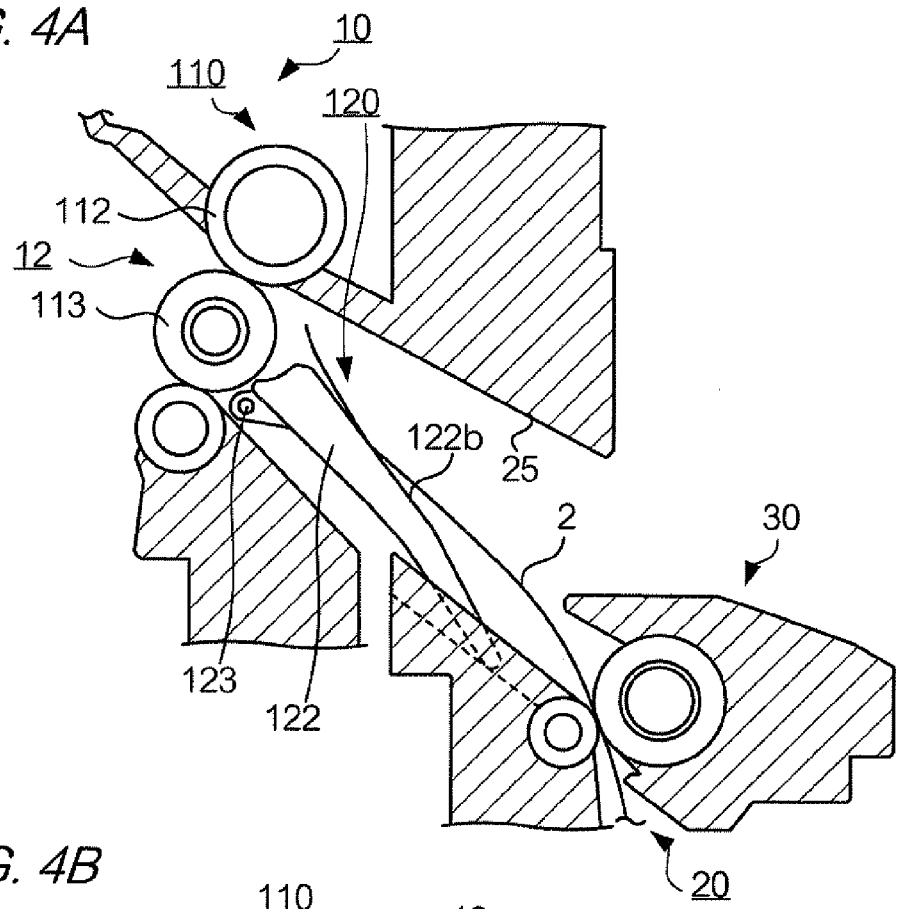
FIGS. 4A and 4B are diagrams for explaining an operation of the directing unit for re-entry of a recording medium.
Figure 4B:
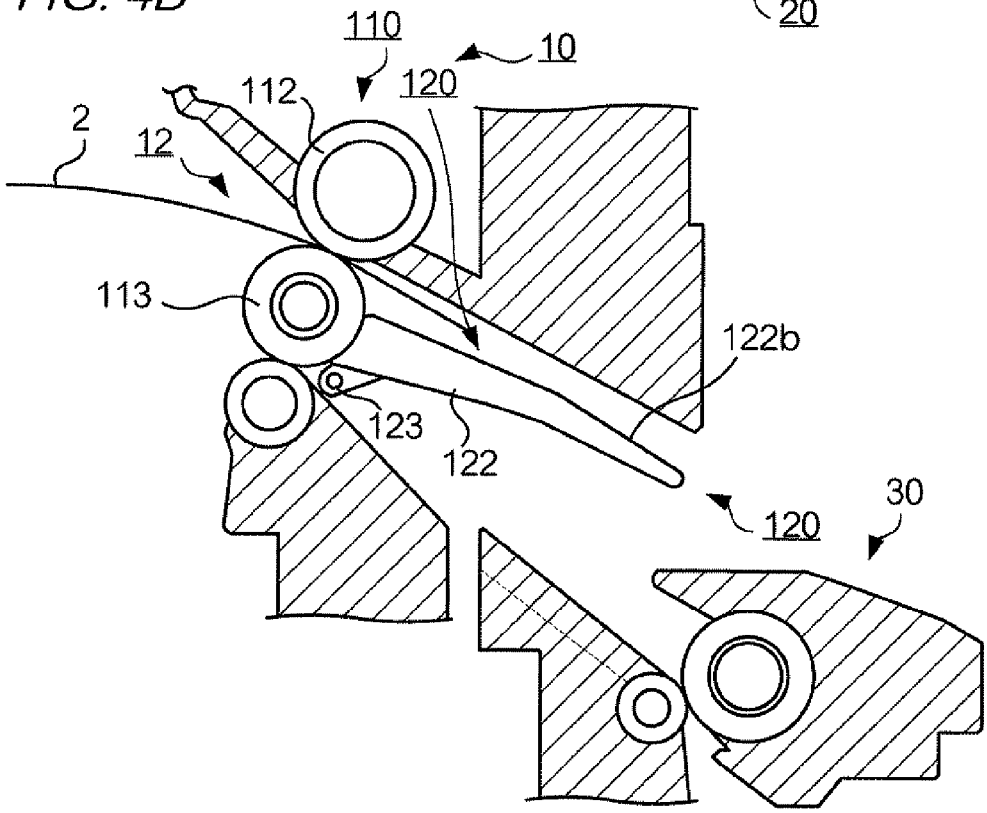

FIGS. 4A and 4B are diagrams for explaining an operation of directing unit 10 for re-entry of a recording medium. Control unit 80 controls drive unit 130 such as a motor to rotate fulcrum 123 clockwise. Drive unit 130 provides directing member 120 with a force larger than the counterclockwise force provided from the urging member, so that directing member 120 rotates clockwise. As a result, directing member 120 (switching member 122) rotates to a position where the clockwise rotation is limited. In the following description, the position at which the clockwise rotation of switching member 122 is limited will be referred to as a "second position." In the present embodiment, the urging member for moving switching member 122 to the first position and drive unit 130 for moving switching member 122 to the second position correspond to and serve as an example of a "moving unit" of the invention. FIG. 4A shows switching member 122 at the second position. Switching member 122 has second directing surface 122*b* on a side of second region 12.

In a state shown in FIG. 4A, roll 23 of first conveying unit 20 conveys a sheet of recording media 2 toward switching member 122. When the conveyed sheet of recording media 2 collides against second directing surface 122*b*, second directing surface 122*b* directs the sheet of recording media 2 toward second region 12, so that the sheet of recording media 2 reaches second region 12. The sheet of recording media 2, which has reached second region 12, is nipped between third roll member 113 and second roll member 112. At this time, control unit 80 controls third roll member 113 to rotate counterclockwise as opposed to the state shown in FIG. 3. Thus, third roll member 113 rotates counterclockwise and second roll member 112 rotates clockwise, to convey the sheet of recording media 2 nipped between them. In the present exemplary embodiment, the counterclockwise direction as viewed in FIG. 3 corresponds to and serves as an example of a "reverse direction" of the invention. When a trailing end of the sheet of recording media 2 reaches second region 12, control unit 80 controls third roll member 113 to stop the rotation. Then, control unit 80 controls drive unit 130 to stop the operation. As a result, switching member 122 is moved back to the first position due to the urging force. It is to be noted that the conveyed sheet of recording media 2 may not collide against second directing surface 122*b*. In such a case, the sheet of recording media 2 collides against second guiding member 25 that is positioned to be opposed to second directing surface 122*b*. Second guiding member 25 guides the conveyance of recording medium 2 from first conveying unit 20 to second region 12.

FIG. 4B shows a state in which switching member 122 has been moved back to the first position, subsequent to the state shown in FIG. 4A. After switching member 122 is moved back to the first position, control unit 80 controls third roll member 113 to rotate clockwise. Third roll member 113 functions in cooperation with second roll member 112 to convey the sheet of recording media 2, which is nipped between these roll members in second region 12, to an inside of image-forming apparatus 1. At this time, when the conveyed sheet of recording media 2 collides against second directing surface 122*b*, second directing surface 122*b* directs the sheet of recording media 2 toward second conveying unit 30. The sheet of recording media 2 is conveyed along second directing surface 122*b* and reaches second conveying unit 30. In this way, directing unit 10 causes re-entry of the sheet of recording media 2 into an inside of image-forming apparatus 1.

FIG. 5 is a diagram for explaining an operation of switching member 122 for conducting the discharging and re-entry of recording media 2 at the same time. FIG. 5 shows a state in which after the state shown in FIG. 4B, first conveying unit 20 conveys a sheet of recording media 3 toward switching member 122. The sheet of recording media 3 is directed by first directing surface 122*a* to reach first region 11. At this time, third roll member 113 is rotated clockwise to convey the sheet of recording media 2 toward an inside of image-forming apparatus 1. Therefore, third roll member 113 conveys the sheet of recording media 3 nipped in first region 11 to an outside of image-forming apparatus 1. In this way, directing unit 10 discharges the sheet of recording media 3 while moving the sheet of recording media 2 back into an inside. As described in the foregoing, directing member 120 is controlled to be positioned at the first position or the second position to switch the destination of conveyance of a recording medium. Also, reversing unit 110 reverses the direction of conveyance of recording media. Owing to such operations of directing member 120 and reversing unit 110, directing unit 10 carries out discharging and re-entry of the sheet of recording media 2.

Figure 6:
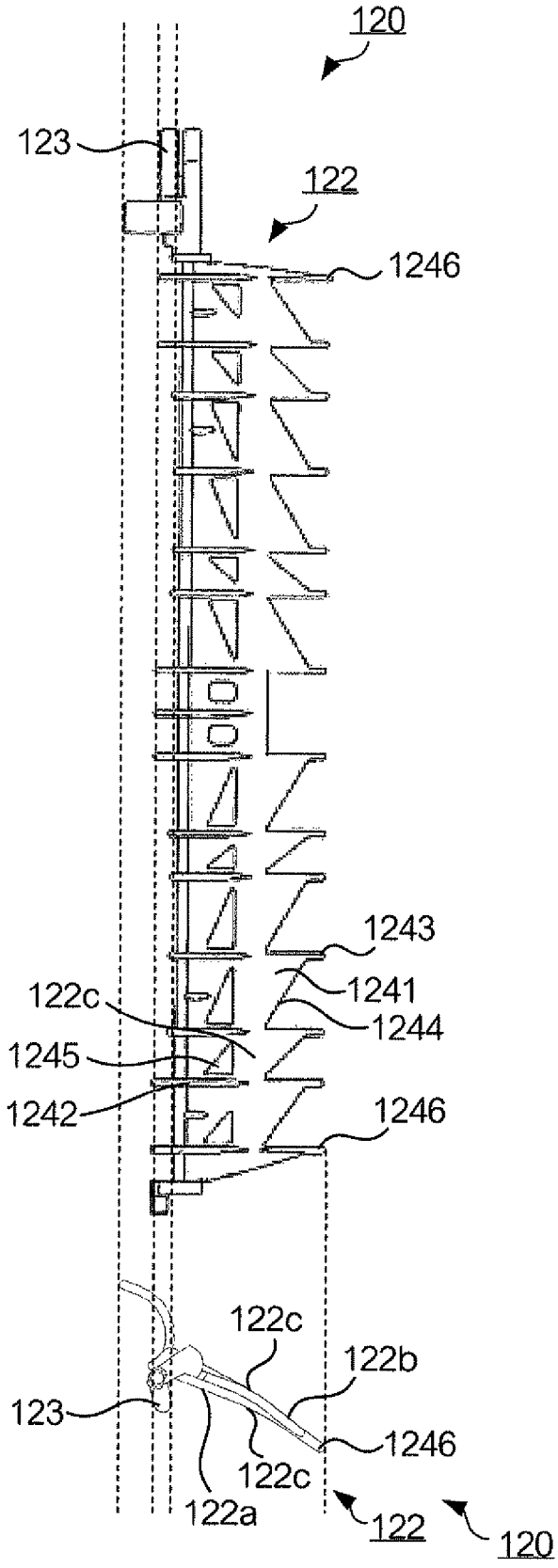
FIG. 6 is a diagram for explaining a directing member.

FIG. 6 is a diagram showing directing member 120 as viewed from a side of second directing surface 122*b*. Switching member 122 has supporting portion 1240 (see FIG. 7), which has a longitudinal direction aligned with a direction of an axis of rotation of fulcrum 123 (hereinafter referred to as an "axial direction"). Switching member 122 also includes colliding portions 1241 and reinforcing portions 1242. Supporting portion 1240 supports colliding portions 1241 and reinforcing portions 1242. Multiple pairs of colliding portions 1241 are formed in such a manner that colliding portions 1241 in each pair are located at axially symmetric positions that correspond to a respective type (or size) of recording media. Colliding portions 1241 are portions against which a conveyed recording medium collides when directing member 120 is installed in image-forming apparatus 1. Reinforcing portions 1242 are ribs provided to reinforce colliding portions 1241.

First protrusions 1243 are protruding portions arranged along a free end (or an end on a side close to the conveying units) of switching member 122. When directing member 120 is installed in image-forming apparatus 1 and is located at the aforementioned second position, first protrusions 1243 are received in respective recesses formed in first guiding member 24 (see FIG. 7), which contacts switching member 122. Outside of a pair of first protrusions 1243 that are positioned at axial ends are formed second protrusions 1246. Second protrusions 1246 are fanned such that a distance from supporting portion 1240 to an end of each second protrusion 1246 is greater than a distance from supporting portion 1240 to an end of each first protrusion 1243. Owing to such a configuration of first protrusions 1243 and second protrusions 1246, when switching member 122 is located at the second position, second protrusions 1246 contact first guiding member 24, but first protrusions 1243 do not contact first guiding member 24. It is to be noted that the number and position of first protrusions 1243 and second protrusions 1246 are not limited to those shown in FIG. 6. For example, the number and position of first protrusions 1243 are determined based on the sizes of recording media used in image-forming apparatus 1 and/or other factors.

A recording medium conveyed from first conveying unit 20 to directing unit 10, such as a sheet of recording media 2 shown in FIG. 4A, tends to be warped in the axial direction (or in a direction perpendicular to the direction of conveyance of the medium), so that axial end portions of the recording medium are positioned lower than a central portion, and this causes the axial end portions of a leading part of the conveyed recording medium to contact certain regions of switching member 122 located at the second position. Each pair of colliding portions 1241 is provided in the regions where axial end portions of a conveyed recording medium of a corresponding size contact. Colliding portions 1241 each have edge 1244 that is inclined with respect to the axial direction such that an outer part of edge 1244 (or a part distant from a center of switching member 122 in the axial direction) is closer to supporting portion 1240 (or the axis of rotation of directing member 120) than an inner part of the same. After directing member 120 is installed in image-forming apparatus 1, when directing member 120 is located at the second position and a leading end of a recording medium conveyed toward supporting portion 1240 collides against edges 1244 of colliding portions 1241, contact points between the recording medium and edges 1244 move along edges 1244 as the recording medium advances, whereby edges 1244 direct the recording medium to second directing surface 122*b*.

Cut-out portions 1245 are spaces formed by portions being cut out of colliding portions 1241. Provision of cut-out portions 1245 reduces a weight of colliding portions 1241 compared to a case where cut-out portions 1245 are absent. However, the provision of cut-out portions 1245 decreases a strength of colliding portions 1241. Thus, each colliding portion 1241 is provided with bent portion 122*c* on second directing surface 122*b* at a position between reinforcing portion 1242 and edge 1244 to compensate for any decrease in strength due to cut-out portions 1245. Thus, bent portion 122*c* has a function of increasing the strength of colliding portions 1241. It is to be noted that directing member 120 of the present exemplary embodiment has bent portion 122*c* on first directing surface 122*a* also, but it may be sufficient to provide bent portion 122*c* on only second directing surface 122*b*, and bent portion 122*c* on first directing surface 122*a* may be omitted.

A part of first directing surface 122*a* and a part of second directing surface 122*b* on a side closer to first projections 1243 with respect to bent portion 122*c* are constituted of lower and upper surfaces of colliding portions 1241, respectively. On the other hand, a part of first directing surface 122*a* and a part of second directing surface 122*b* on a side closer to supporting portion 1240 with respect to bent portion 122*c* are constituted of end surfaces of reinforcing portions 1242 on a side of first directing surface 122*a* and on a side of second directing surface 122*b*, respectively.

Figure 7:
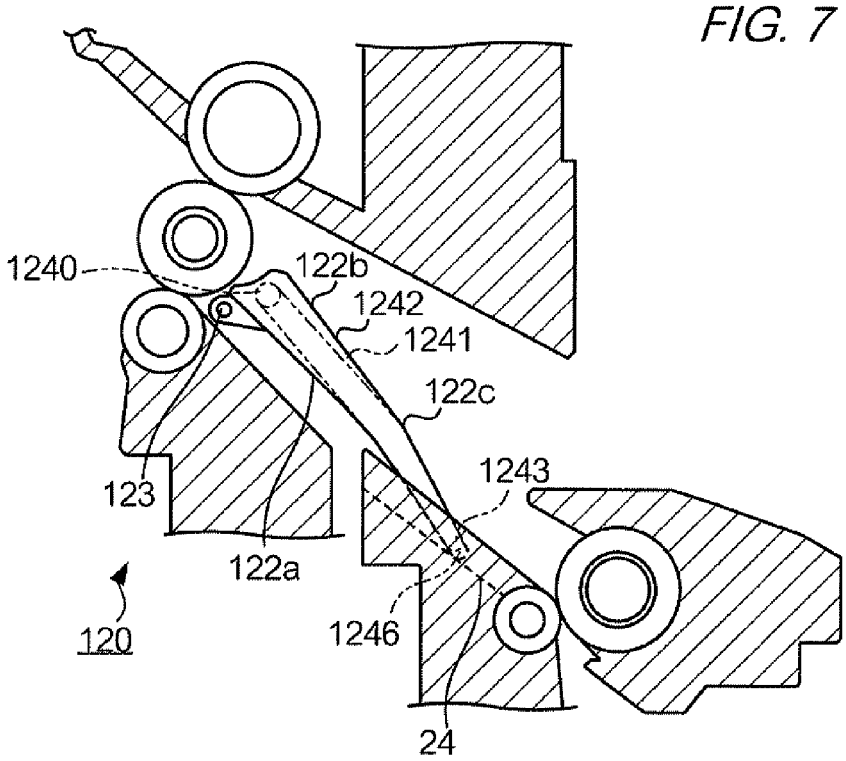
FIG. 7 is a diagram for explaining a state of a switching member at a second position.

FIG. 7 is a diagram for explaining a state of switching member 122 at the second position. First guiding member 24 includes multiple recesses for receiving first protrusions 1243 and second protrusions 1246 when switching member 122 is at the second position. Thus, in the state shown in FIG. 7, first protrusions 1243 and second protrusions 1246 have entered into respective recesses of first guiding member 24. First guiding member 24 guides conveyance of a recording medium from first conveying unit 20 to first region 11. In the present exemplary embodiment, first guiding member 24 corresponds to and serves as an example of a "guiding member" of the invention. As stated in the foregoing, a part of first directing surface 122*a* and a part of second directing surface 122*b* on a side close to supporting portion 1240 are formed by reinforcing portions 1242.

Depending on a shape of a portion of directing member 120 near second region 12, a malfunction may occur. An example of such a malfunction will be explained below using directing member 120*p*, which has a shape different from that of second directing surface 122*b* of directing member 120. Directing member 120*p* has the same configuration as directing member 120 except for the shape of second directing surface 122*b*.

Figure 8A:
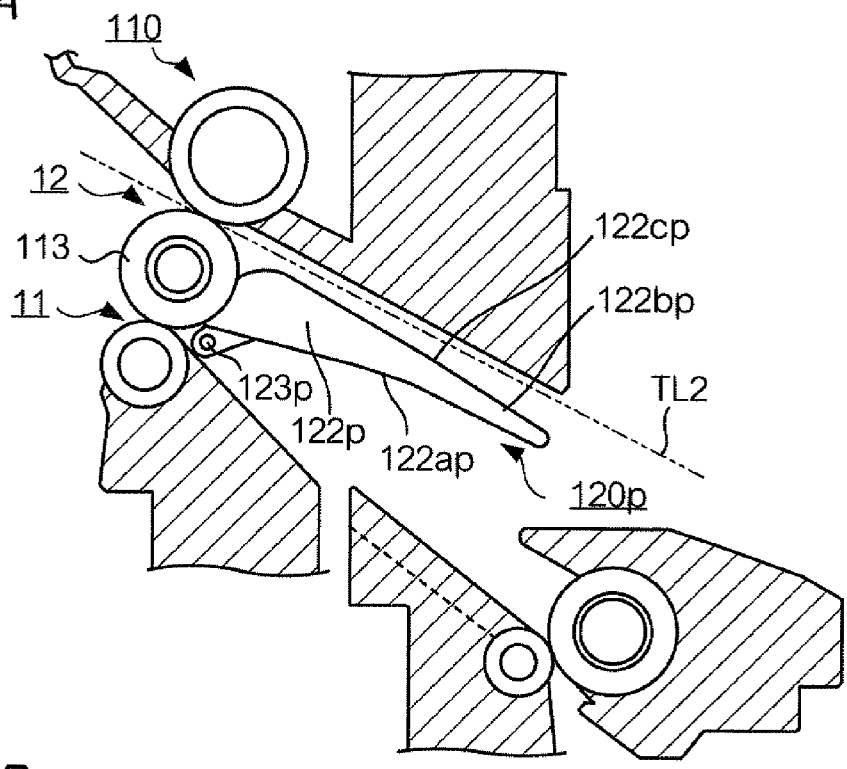
FIGS. 8A and 8B are diagrams for explaining a malfunction caused by a directing member having a shape different from that of the directing member shown in FIG. 3.
Figure 8B:
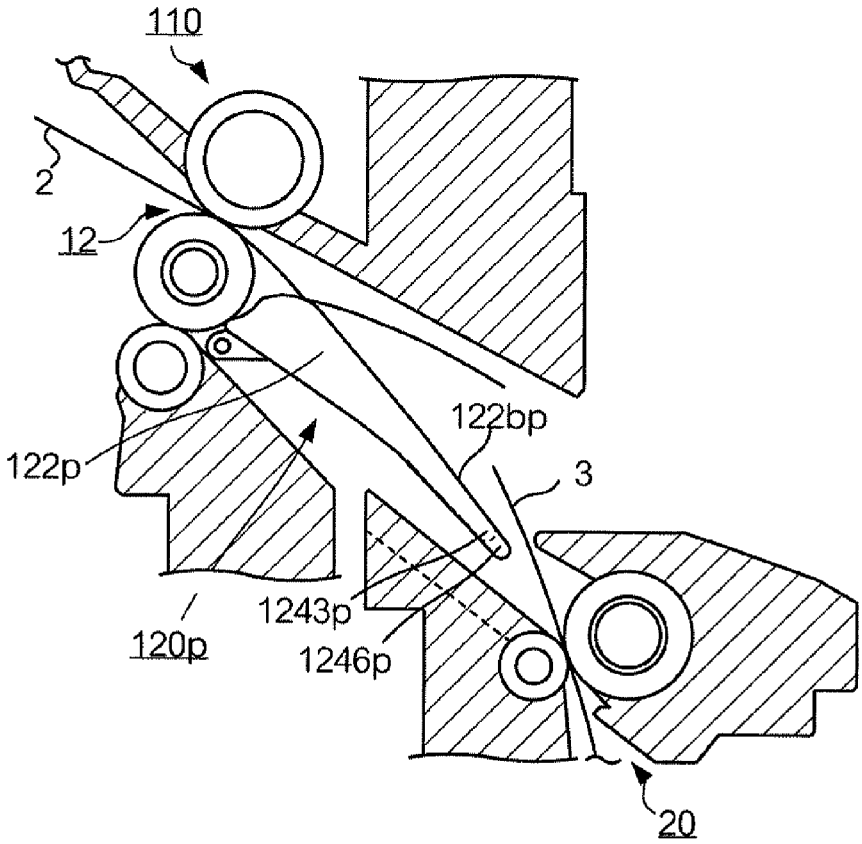

FIGS. 8A and 8B are diagrams for explaining a malfunction caused by directing member 120*p*. FIG. 8A is a diagram showing a state where directing member 120*p* is at the first position. A shape of a part of second directing surface 122*bp* of directing member 120*p* between bent portion 122*cp* and supporting portion 1240 is different from that of directing member 120. Specifically, in directing member 120*p*, when directing member 120*p* is at the first position, a distance from second directing surface 122*bp* to tangential line TL2, which passes through second region 12 and is common to second and third roll members 112 and 113, decreases toward second region 12.

FIG. 8B is a diagram showing a state in which the position of directing member 120*p* is changed due to collision by a recording medium. A sheet of recording media 2 is conveyed from second region 12 toward second conveying unit 30, and collides with second directing surface 122*bp*. The collision of an end portion of the sheet of recording media 2 against second directing surface 122*bp* generates a force urging directing member 120*p* to rotate clockwise. If an incident angle of the colliding recording medium (or an angle of a leading part of recording medium with respect to a direction normal to a part of second directing surface 122*bp* where the recording medium collides against) is small, the collision may generate a force large enough to flex switching member 122*p*. In such a state, if a sheet of recording media 3 is conveyed from first conveying unit 20, the sheet of recording media 3 is unintentionally directed into a space on a side of second directing surface 122*bp* of the flexed switching member 122*p* with respect to first and second protrusions 1243*p* and 1246*p*.

Figure 9A:
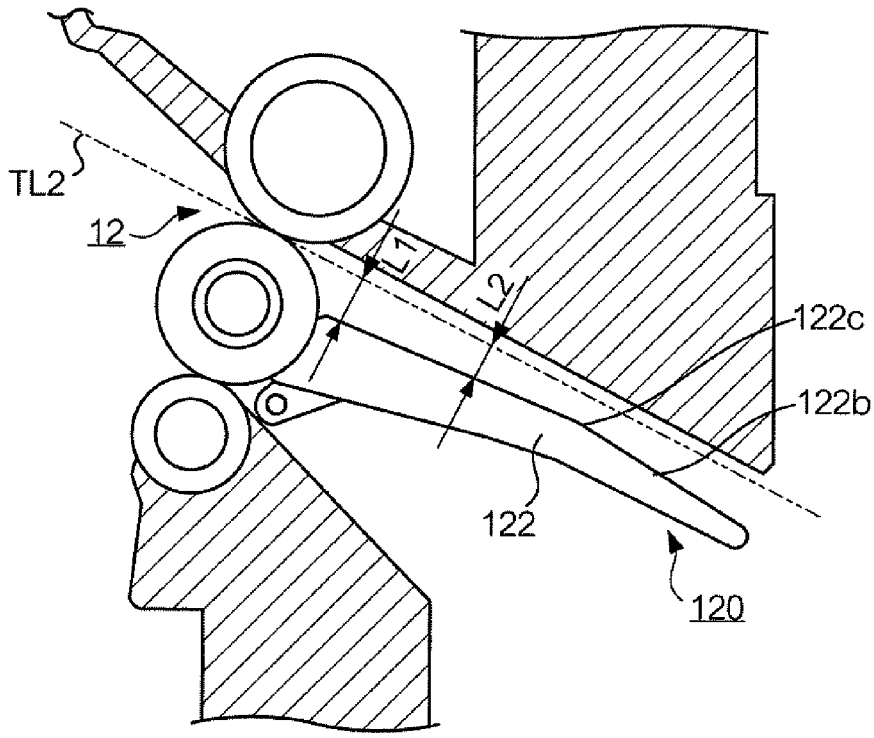
FIGS. 9A and 9B are diagrams for comparing the directing member shown in FIG. 3 and the directing member shown in FIG. 8A.
Figure 9B:
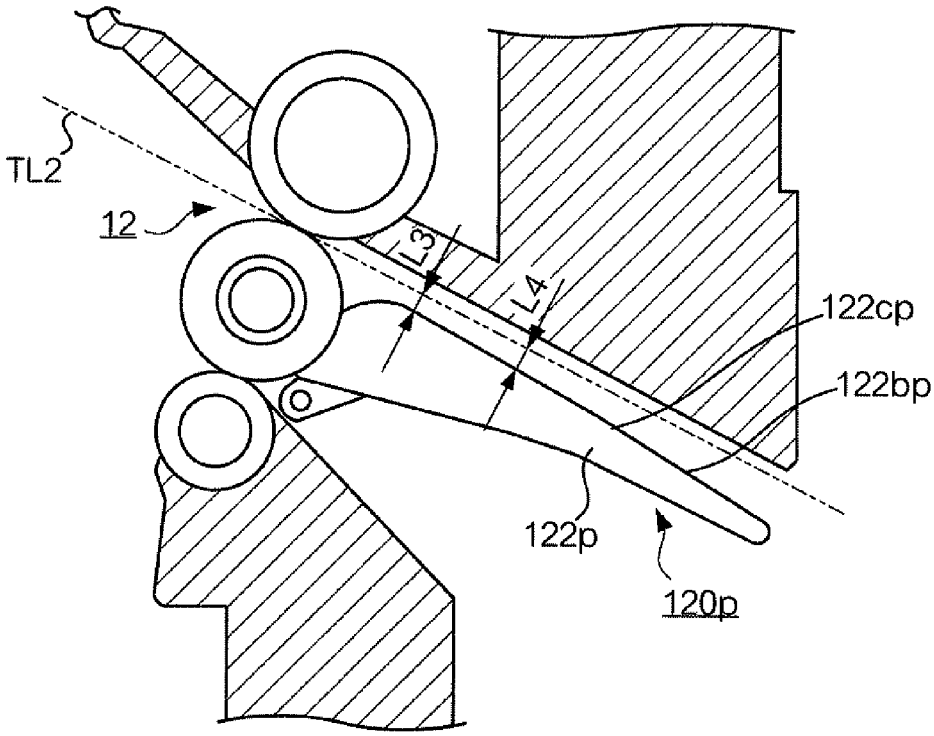

FIGS. 9A and 9B are diagrams for comparing directing member 120 and directing member 120*p*. FIG. 9A is a diagram for explaining directing member 120. Here, a distance from second directing surface 122*b* to second tangential line TL2 is considered at two points, for example, within a region closer to second region 12 relative to bent portion 122*c* (or within a region between bent portion 122*c* and supporting portion 1240). Specifically, by comparing distance L1 at one point in the region closer to second region 12 relative to bent portion 122*c* and distance L2 at another point that is closer to bent portion 122*c* than the one point, it is understood that switching member 122 has a part in which distance L1 is equal to or greater than distance L2. FIG. 9B is a diagram for explaining directing member 120*p*. Here, a distance from second directing surface 122*bp* to second tangential line TL2 is considered at two points, for example, within a region closer to second region 12 relative to bent portion 122*cp* (or within a region between bent portion 122*cp* and supporting portion 1240). Specifically, by comparing distance L3 at one point in the region closer to second region 12 relative to bent portion 122*cp* and distance L4 at another point that is closer to bent portion 122*cp* than the one point, it is understood that switching member 122*p* has a part in which distance L3 is smaller than distance L4. In other words, directing member 120*p* has a part in which a distance between second directing surface 122*bp* and second tangential line TL2 reduces toward second region 12, in the region closer to second region 12 relative to bent portion 122*cp*. In contrast, directing member 120 shown in FIG. 9A does not include a part in which a distance between second directing surface 122*b* and second tangential line TL2 reduces toward second region 12, in the region closer to second region 12 relative to bent portion 122*c*. Thus, a larger space is defined between second tangential line TL2 and directing member 120 in the region closer to second region 12 relative to bent portion 122*c* compared to a space defined between second tangential line TL2 and directing member 120*p*.

FIG. 10 is a diagram for explaining a shape of directing member 120. FIG. 10 shows directing member 120 located at the first position. In FIG. 1, in addition to the aforementioned second tangential line TL2, first tangential line TL1, which is a tangential line that passes through first region 11 and is common to first roll member 111 and third roll member 113, is shown. Directing member 120 has a region of first directing surface 122*a* on a side closer to third roll member 113 relative to bent portion 122*c*, in which, when directing member 120 is located at the first position, a distance between first directing surface 122*a* and first tangential line TL1 reduces toward first region 11. Further, directing member 120 has a region of second directing surface 122*b* on a side closer to third roll member 113 relative to bent portion 122*c*, in which, when directing member 120 is located at the first position, a distance between second directing surface 122*b* and second tangential line TL2 increases toward second region 12. Furthermore, fulcrum 123 is provided at a position apart from first directing surface 122*a* toward first tangential line TL1.

Here, a distance between first directing surface 122*a* and first tangential line TL1 is considered at two points, for example, in a region closer to first region 11 relative to bent portion 122*c*. Specifically, by comparing distance L5 at one point in the region closer to first region 11 relative to bent portion 122*c* and distance L6 at another point that is closer to bent portion 122*c* than the one point, it is understood that switching member 122 has a part in which distance L5 is equal to or smaller than distance L6. Also, in this region, switching member 122 has a part in which distance L7 between second directing surface 122*b* and second tangential line TL2 is larger than distance L5 between first directing surface 122*a* and first tangential line TL1.

Modifications

In the foregoing, an exemplary embodiment of the present invention is explained, but the present invention may be applied to another embodiment. For example, in the above-described exemplary embodiment, a re-entering recording medium is guided by second conveying unit 30 to the first conveyance path, but the re-entering recording medium may be conveyed by second conveying unit 30 to a container (not shown in the drawings) for containment, instead of being conveyed to the first conveyance path.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium-directing device comprising:

a first roll member that is rotatable about a first rotation shaft;

a second roll member that is rotatable about a second rotation shaft;

a third roll member that is rotatable about a third rotation shaft in forward and reverse directions and that respectively contacts the first roll member and the second roll member in first and second regions, which regions are at different positions, such that when the third roll member is rotated in the forward direction, a medium conveyed along a first conveyance path is nipped between the first roll member and the third roll member in the first region, and when the third roll member is rotated in the reverse direction, the medium conveyed along the first conveyance path is nipped between the second roll member and the third roll member in the second region;

a directing member that has a fulcrum, a first directing surface, and a second directing surface provided with a bent portion, and that is rotatable about the fulcrum between a first position and a second position such that when the directing member is located at the first position, the medium conveyed along the first conveyance path is directed by the first directing surface toward the first region, and when the directing member is located at the second position, the medium conveyed along the first conveyance path is directed by the second directing surface toward the second region;

a guiding unit that, when the third roll member is rotated in the forward direction with a medium being nipped between the second roll member and the third roll member in the second region, guides the medium conveyed by the rotation of the third roll member toward a second conveyance path that is different from the first conveyance path; and a moving unit that moves the directing member between the first position and the second position, the moving unit moving the directing member to the first position when the third roll member is rotated in the forward direction with a medium being nipped between the second roll member and the third roll member in the second region, wherein the fulcrum of the directing member is provided at a position that, when the directing member is located at the first position, is apart from the first directing surface toward a first tangential line, the first tangential line being a tangential line that passes through the first region and is tangential to each of the first roll member and the third roll member, and the directing member includes a region of the first directing surface, in which, when the directing member is located at the first position, a distance between the first directing surface and the first tangential line reduces toward the first region, and a region of the second directing surface on a side closer to the second region relative to the bent portion, in which, when the directing member is located at the first position, a distance between the second directing surface and a second tangential line increases toward the second region, the second tangential line being a tangential line that passes through the second region and is tangential to each of the second roll member and the third roll member.

2. The medium-directing device according to claim 1, wherein the directing member has an inclined edge in regions where end portions of the medium in an axial direction contact, the axial direction being a direction of an axis of rotation of the directing member and the inclined edge being inclined with respect to the axial direction such that an outer part of each edge is closer to the axis of rotation of the directing member than an inner part of the same.

3. The medium-directing device according to claim 2, further comprising a guiding member that contacts the directing member when the directing member is located at the second position, to guide conveyance of the medium from the first conveyance path to the second region, wherein the directing member has a plurality of protrusions on an end on a side close to the guiding unit, and the guiding member has a plurality of recesses that receive the plurality of protrusions of the directing member when the directing member is located at the second position.

4. The medium-directing device according to claim 3, wherein the plurality of protrusions include at least one first protrusion that does not contact the guiding member and at least one second protrusion that contacts the guiding member.

5. The medium-directing device according to claim 1, further comprising a guiding member that contacts the directing member when the directing member is located at the second position, to guide conveyance of the medium from the first conveyance path to the second region, wherein the directing member has a plurality of protrusions on an end on a side close to the guiding unit, and the guiding member has a plurality of recesses that receive the plurality of protrusions of the directing member when the directing member is located at the second position.

6. The medium-directing device according to claim 5, wherein the plurality of protrusions include at least one first protrusion that does not contact the guiding member and at least one second protrusion that contacts the guiding member.

7. An image-forming apparatus comprising:

the medium-directing device according to claim 1; and an image-forming unit that forms a first image on one surface of a medium conveyed along the first conveyance path by a conveying unit and that forms a second image on the opposite surface of the medium, which is guided to the second conveyance path by the guiding unit.

* * * * *